US005306013A

United States Patent [19]

Germinario

[11] Patent Number: 5,306,013

[45] Date of Patent: Apr. 26, 1994

[54] PROJECTILE ACCURACY SIGNALLING APPARATUS

[76] Inventor: Philip Germinario, 27 Conger St., Dover, N.J. 07801

[21] Appl. No.: 49,323

[22] Filed: Apr. 21, 1993

[51] Int. Cl.[5] ..... A63B 63/04

[52] U.S. Cl. ..... 273/184 A

[58] Field of Search ..... 273/181 R, 181 C, 184 R, 273/184 A, 184 B, 183 R, 378

[56] References Cited

U.S. PATENT DOCUMENTS

| | | | |
|---|---|---|---|
| 1,136,708 | 4/1915 | Osborn | 273/184 A |
| 1,798,140 | 3/1931 | Byers | 273/184 A |
| 1,961,060 | 5/1934 | McCarthy | 273/184 A |
| 4,120,496 | 10/1978 | Niina | 273/184 A X |
| 5,145,178 | 9/1992 | Ropars | 273/184 A |
| 5,181,721 | 1/1993 | Halliburton | 273/184 A X |

FOREIGN PATENT DOCUMENTS

| | | | |
|---|---|---|---|
| 2188556 | 10/1987 | United Kingdom | 273/184 A |

*Primary Examiner*—William E. Stoll
*Attorney, Agent, or Firm*—S. Michael Bender

[57] ABSTRACT

A new and improved apparatus for signalling accuracy of a path of a projectile moving on a floor or ground surface includes an audible signal assembly located above and near floor or ground level. The audible signal assembly provides an audible signal when a target element of the assembly is hit by a projectile that moves along the floor or ground. A support assembly supports the audible signal assembly above and near enough to the floor or ground, such that the target element of the audible signal assembly can be hit by the moving projectile. The support assembly includes two triangular-shaped end units in which bases of the end units are supported by the floor or ground surface. Traverse rod supports are connected to the end units near apices of the end units. A traverse rod extends traversely between the end units and is supported by the traverse rod supports. The audible signal assembly is supported by the traverse rod. The audible signal assembly includes a bell assembly which includes a bell member and a clapper assembly. A target assembly is connected to the clapper assembly. The target assembly includes a target element support and target element. When the target element is hit by the projectile, the force of impact is transmitted from the target element, through the target element support, and to the clapper assembly which strikes the bell element for sounding an audible signal.

15 Claims, 4 Drawing Sheets

PROJECTILE ACCURACY SIGNALLING APPARATUS

BACKGROUND OF THE INVENTION

1. Field of the Invention

The present invention relates generally to apparatus designed to enable practicing of skills in sports employing floor or ground based projectile, and more particularly, to a practice device designed to enable practicing skills and to provide a signal during accurate performance.

2. Description of the Prior Art

A number of devices are disclosed in the prior art for enabling a person to practice a sports skill in their home or office. More particularly, the following U.S. patents disclose devices to enable a golfer to improve putting skills in the home or office: U.S. Pat. Nos. 3,672,682; 4,826,174; 5,007,644; 5,071,129; and U.S. Des. No. 311,216. More specifically, U.S. Pat. No. 3,672,682 relates to a device worn on a golfer's arms to stabilize the arms during putting. U.S. Pat. No. 4,826,174 discloses a putting practice device a complex planar surface with an number of channels and targets. U.S. Pat. No. 5,007,644 discloses a one-piece hilly ramp designed to improve skills in controlling the speed of the golf ball. U.S. Pat. No. 5,071,129 discloses a sighting device, employing an articulated mirror, for improving positioning of a putter head during putting. U.S. Des. No. 311,216 discloses a golf putting ramp having a hole and a receptacle for balls.

In view of the above, it would be desirable if a golf putting practice device would avoid restraining one's arms during putting. It would also be desirable if a golf putting practice device were provided that avoided the used of a complex planar surface with a number of channels and targets. In addition, it would be desirable if a golf putting practice device were provided that avoided the use of a one-piece hilly ramp. It would also be desirable if a golf putting practice device were provided that avoided the use of a complex sighting device that employs an articulated mirror.

Furthermore, in a golf practice device that has a cup, such as U.S. Des. No. 311,216, a golfer must remove balls that have gone into the cup very often because a cup can hold only 1 or 2 or 3 balls. In this sense, the golfer is penalized for his accuracy. The more accurate the putting, the more often the golfer must removes balls from the cup. In this respect, it would be desirable if a golf putting practice device were provided that did not cause the user to empty a cup often when the putts are generally accurate.

Moreover, none of the prior art cited above discloses a golf putting practice device that provides an audible signal when accurate putting has been effected.

Thus, while the foregoing body of prior art indicates it to be well known to use devices to aid in the practice of golf skills in a home or office, the prior art described above does not teach or suggest a projectile accuracy signalling apparatus which has the following combination of desirable features: (1) provides an audible signal when accurate putting has been effected; (2) avoids restraining one's arms during putting; (3) avoids the used of a complex planar surface with a number of channels and targets; (4) avoids the use of a one-piece hilly ramp; (5) avoids the use of a complex sighting device that employs an articulated mirror; and (6) does not cause the user to empty a cup often when the putts are generally accurate. The foregoing desired characteristics are provided by the unique projectile accuracy signalling apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved apparatus for signalling accuracy of a path of a projectile moving on a floor or ground surface. The apparatus includes an audible signal assembly located above and near floor or ground level. The audible signal assembly (e.g. a bell with a clapper) provides an audible signal when a target element of the assembly is hit by a projectile (e.g. a putted golf ball) that moves along the floor or ground. A support assembly supports the audible signal assembly above and near enough to the floor or ground, such that the target element of the audible signal assembly can be hit by the moving projectile. The support assembly includes two triangular-shaped end units in which bases of the end units are supported by the floor or ground surface. Traverse rod supports are connected to the end units near apices of the end units. A traverse rod extends traversely between the end units and is supported by the traverse rod supports. The audible signal assembly is supported by the traverse rod. The audible signal assembly includes a bell assembly which includes a bell member and a clapper assembly. A target assembly is connected to the clapper assembly. The target assembly includes a target element support and target element. When the target element is hit by the projectile, the force of impact is transmitted from the target element, through the target element support, and to the clapper assembly which strikes the bell element for sounding an audible signal.

The traverse rod supports include flat top surfaces for stabilizing support of the traverse rod on the supports. Similarly, the bases of the end units include stabilizing feet for providing improved stability to the apparatus. The stabilizing feet include flat bottom surfaces for added stability.

A curved wall, connected to the support assembly, may be provided for returning a moving projectile, which moves up a portion of the curved wall, back toward a person who initially moved the projectile to the curved wall.

A ramp and receptacle may be located on the floor or ground. The ramp guides projectiles up from floor or ground level into the receptacle. The receptacle retains the projectiles.

An audible signal counting assembly may be used for counting and displaying a count of audible signals indicating cumulative projectile accuracy. The audible signal counting assembly may include a microphone for sensing the audible signals and for providing an electrical signal, and means for receiving and counting electrical signals from the microphone. The audible signal counting assembly may be powered by batteries and may include a digital display.

The audible signal assembly may be comprised of a bell assembly, which includes a bell member and a clapper assembly. The bell assembly itself may be positioned above and near the floor or ground surface for sounding an audible signal when the bell assembly itself is hit by a projectile that moves along the floor or ground.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least four preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, not is it intended to be limiting as to the scope of the invention in any way.

It is therefore an object of the present invention to provide a new and improved projectile accuracy signalling apparatus which has all of the advantages of the prior art and none of the disadvantages.

It is another object of the present invention to provide a new and improved projectile accuracy signalling apparatus which may be easily and efficiently manufactured and marketed.

It is a further object of the present invention to provide a new and improved projectile accuracy signalling apparatus which is of durable and reliable construction.

An even further object of the present invention is to provide a new and improved projectile accuracy signalling apparatus which is susceptible of a low cost of manufacture with regard to both materials and labor, and which accordingly is then susceptible of low prices of sale to the consuming public, thereby making such projectile accuracy signalling apparatus available to the buying public.

Still yet a further object of the present invention is to provide a new and improved projectile accuracy signalling apparatus that provides an audible signal when accurate projectile placement has been effected.

Still another object of the present invention is to provide a new and improved projectile accuracy signalling apparatus that avoids restraining a user's arms during projectile striking.

Yet another object of the present invention is to provide a new and improved projectile accuracy signalling apparatus that avoids the use of a complex planar surface with an number of channels and targets.

Even another object of the present invention is to provide a new and improved projectile accuracy signalling apparatus that avoids the use of a one-piece hilly ramp.

Still a further object of the present invention is to provide a new and improved projectile accuracy signalling apparatus that avoids the use of a complex sighting device that employs an articulated mirror.

Yet another object of the present invention is to provide a new and improved golf putting practice device that does not cause the user to empty a cup often when the putts are generally accurate.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved projectile accuracy signalling apparatus embodying the principles and concepts of the present invention will be described.

Figure 1:
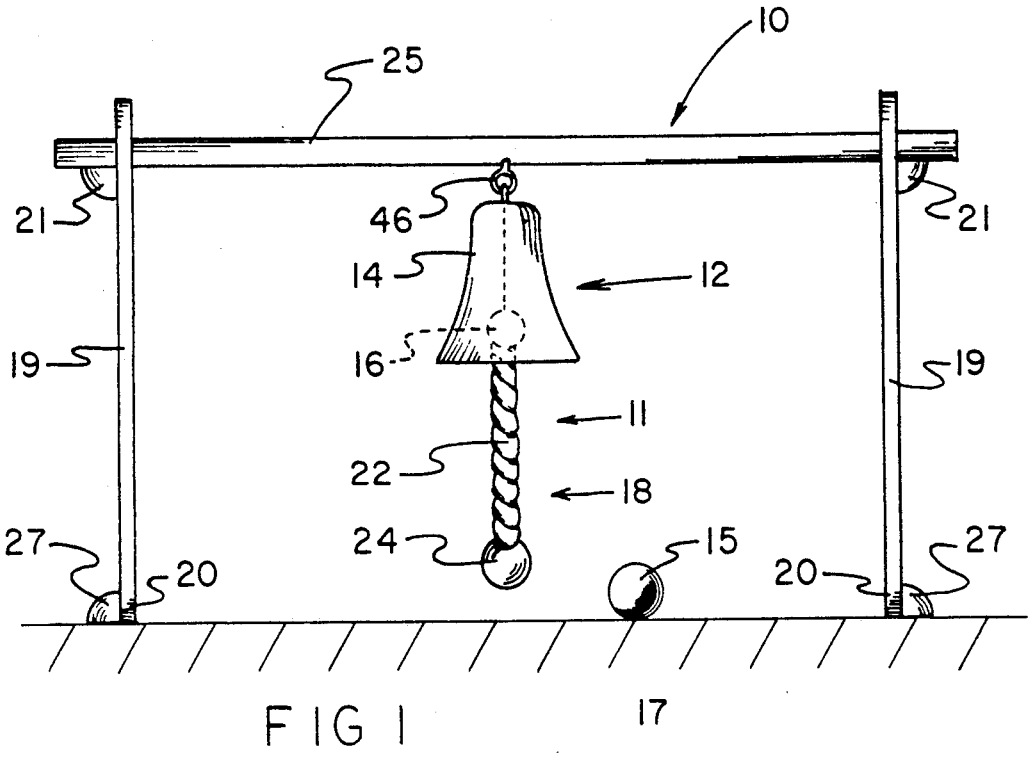
FIG. 1 is a front view showing a first preferred embodiment of the projectile accuracy signalling apparatus of the invention.
Figure 2:
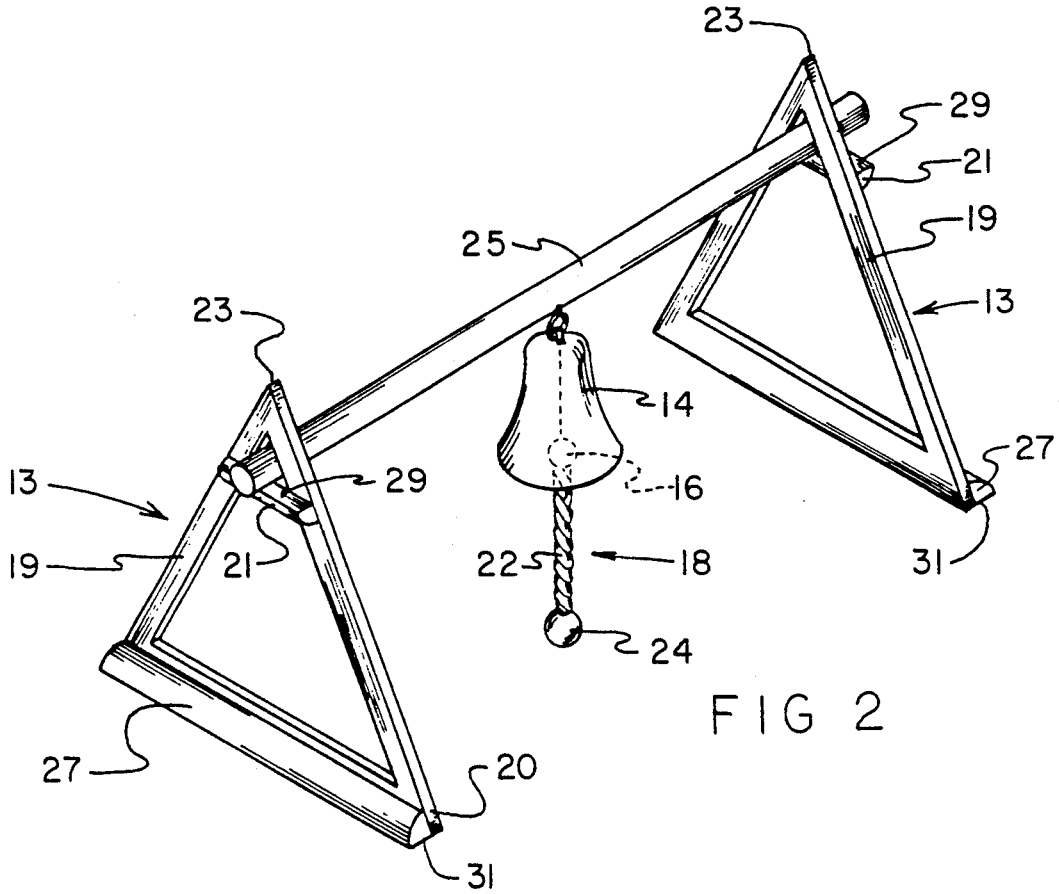
FIG. 2 is a perspective view of the embodiment of the projectile accuracy signalling apparatus of the invention shown in FIG. 1.
Figure 3:
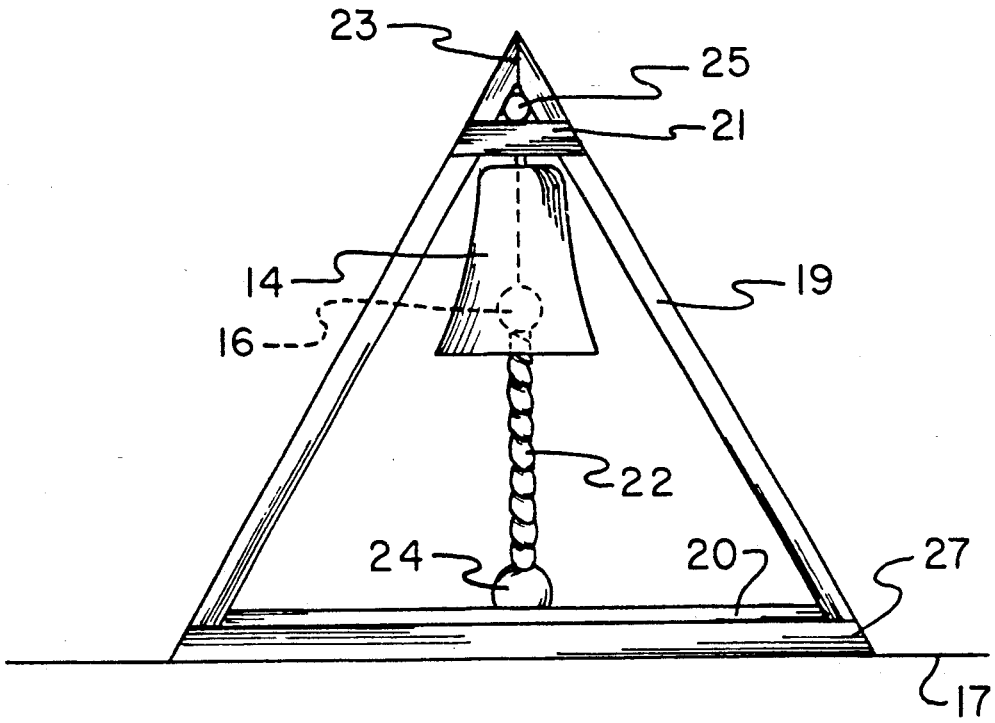
FIG. 3 is a side view of the embodiment of the projectile accuracy signalling apparatus of the invention shown in FIG. 1.

Turning initially to FIGS. 1-3, there is shown a first exemplary embodiment of the projectile accuracy signalling apparatus of the invention generally designated by reference numeral 10. In its preferred form, projectile accuracy signalling apparatus 10 is used for signalling accuracy of a path of a projectile 15 (e.g. putted golf ball 15) moving on a floor 17 or ground surface. The apparatus 10 includes and audible signal assembly 11 which has a target element 24. A support assembly 13 supports the target element 24 of the audible signal assembly 11 above and near enough to the floor 17 or ground, such that the target element 24 can be hit by the projectile 15 that moves on the floor 17 or ground surface.

The support assembly 13 includes two triangular-shaped end units 19 in which bases 20 of the end units 19 are supported by the floor 17 or ground surface. Traverse rod supports 21 are connected to the end units 19 near apices 23 of the end units 19. A traverse rod 25 extends traversely between the end units 19 and is supported by the traverse rod supports 21. The audible signal assembly 11 is supported by the traverse rod 25. The traverse rod supports 21 include flat top surfaces 29 for stabilizing support of the traverse rod 25 on the supports 21. Similarly, the bases 20 of the end units 19 include stabilizing feet 27 for providing improved stability to the apparatus. The stabilizing feet 27 include flat bottom surfaces 31 for added stability.

The audible signal assembly 11 includes a bell assembly 12 which includes a bell member 14 and a clapper assembly 16. The bell assembly 12 is connected to the transverse rod 25 with a circular eye assembly 46 having a shaft screwed into the transverse rod 25. The clapper assembly 16 sounds an audible signal when the clapper assembly 16 is actuated by the projectile 15. More specifically, a target assembly 18 is connected to the clapper assembly 16. The target assembly 18 includes a target element support 22 (rope 22) and a target element 24 (a ball-like object). The target element 24 is supported near and above the ground or floor 17 level and receives impact of a projectile 15 that is aimed at the target element 24 and that moves along the floor 17 or ground. When the target element 24 is hit by the moving projectile 15, the force of impact is transmitted through the target element support 22 to the clapper assembly 16 for striking the bell element 14 for sounding an audible signal. The clapper assembly 16 is connected to the bell member 14.

Figure 4:
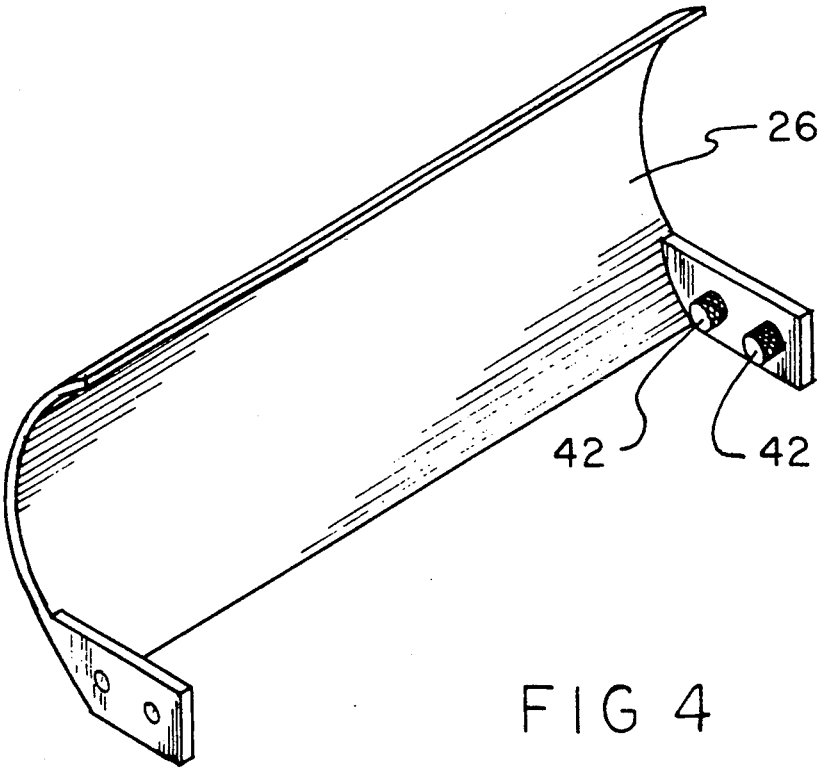
FIG. 4 is a circular wall, for returning hit balls, that can be attached to the embodiment of the projectile accuracy signalling apparatus of the invention shown in FIG. 1. When the circular wall is attached to the embodiment shown in FIG. 1, a second embodiment of the invention is provided.

As shown in FIG. 4, a curved wall 26 may be employed. In use, the curved wall 26 is connected to the support assembly 13 and serves to return a moving projectile 15, which moves up a portion of the curved wall 26, back toward a person who initially moved the projectile 15 to the curved wall 26. Thumb screws 42 can be used to attach the curved wall 26 to threaded holes in the bases 20 of the end units 19.

Figure 6:
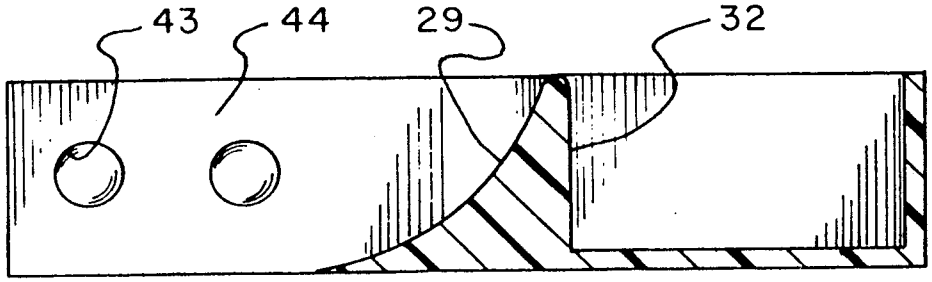
FIG. 6 is a cross-sectional view of the embodiment of the invention shown in FIG. 5 taken along the line 6—6 thereof.
Figure 5:
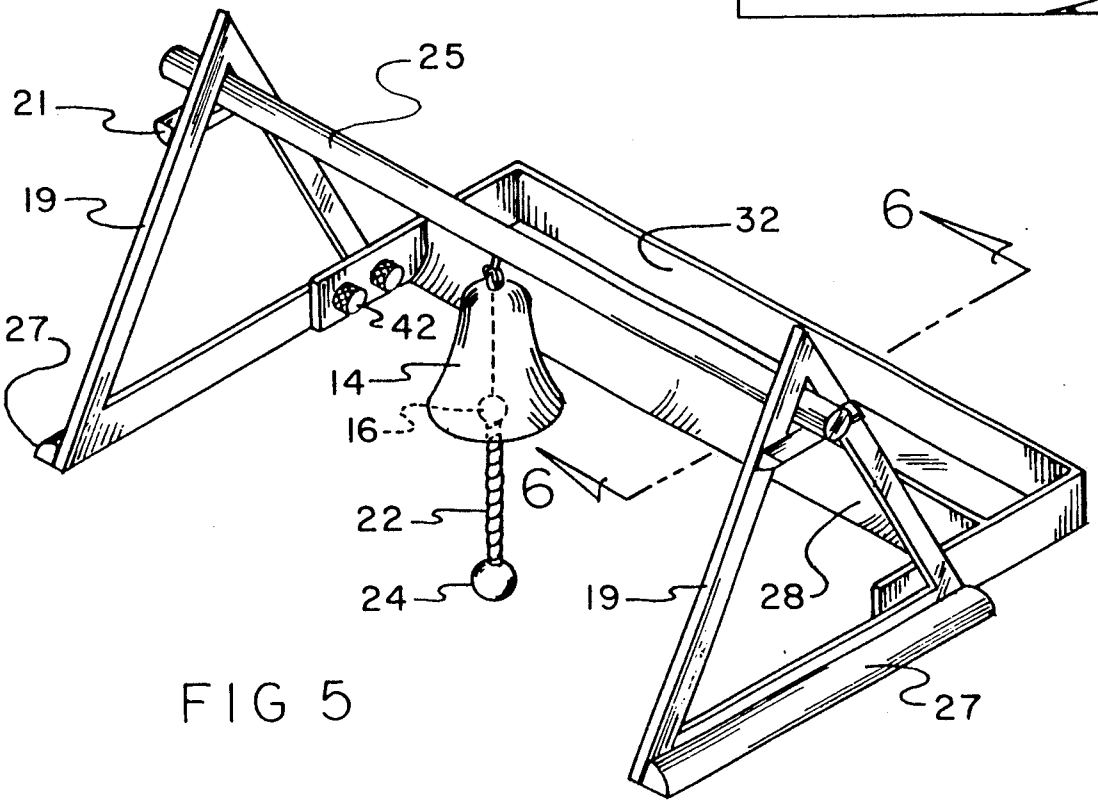
FIG. 5 is a perspective view of a third preferred embodiment of the invention in which a ramp and receptacle is provided.

Turning to FIGS. 5–6, another embodiment of the invention is shown. Reference numerals are shown that correspond to like reference numerals that designate like elements shown in the other figures. In addition, a ramp 28 and a receptacle 32 are located on the floor 17 or ground. The ramp 28 guides projectiles 15 up from floor 17 or ground level into the receptacle 32. The receptacle 32 retains the projectiles 15. Thumb screws 42, with shafts (not shown) passing through apertures 43 in a side wall 44 can be used to attach the ramp-/receptacle assembly to complementary threaded holes in the bases 20 of the end units 19.

Figure 7:
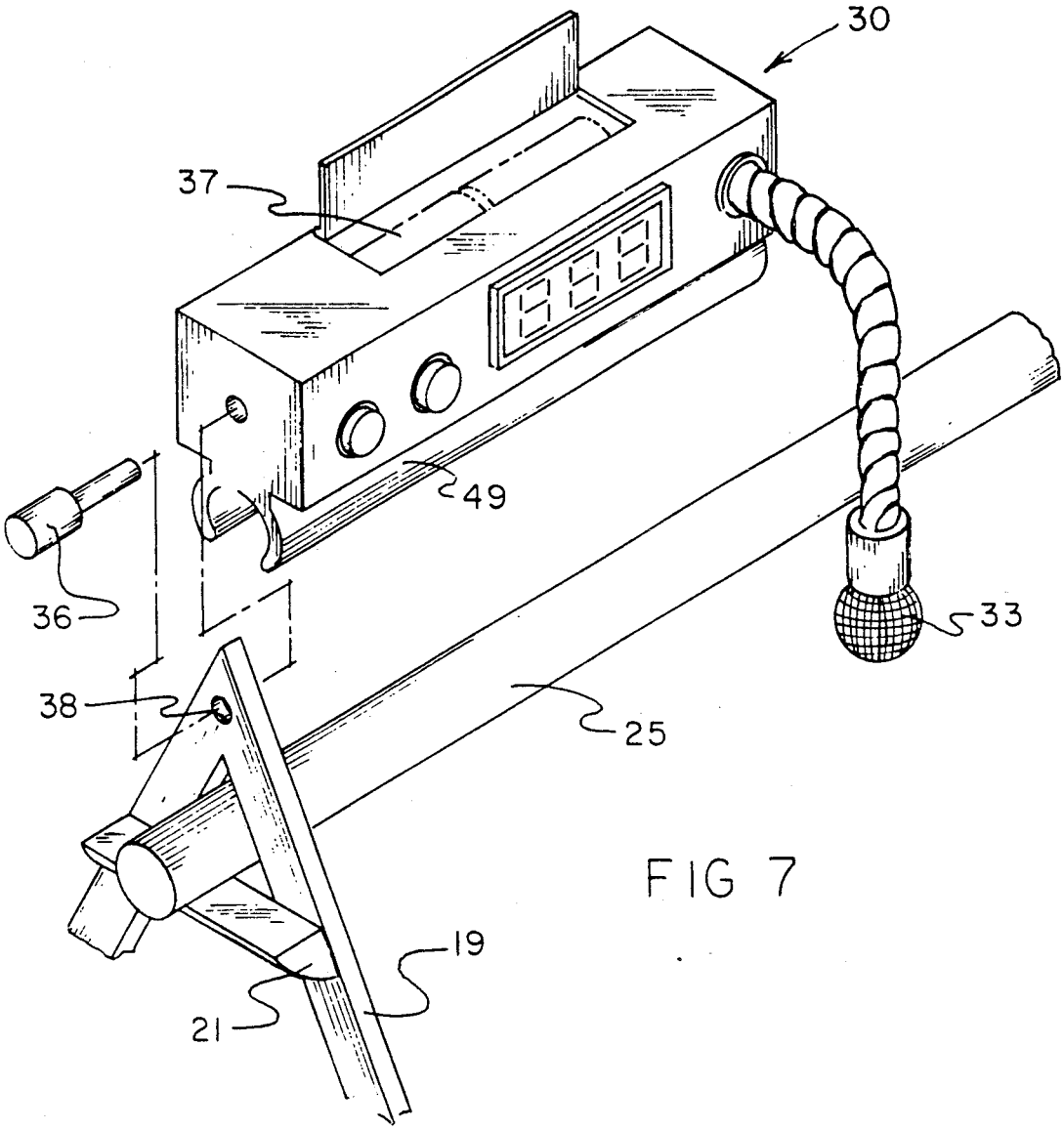
FIG. 7 is an enlarged, partially exploded, partial perspective view of a fourth preferred embodiment of the invention which includes a microphone and an electronic assembly for counting times the bell has been rung.
Figure 8:
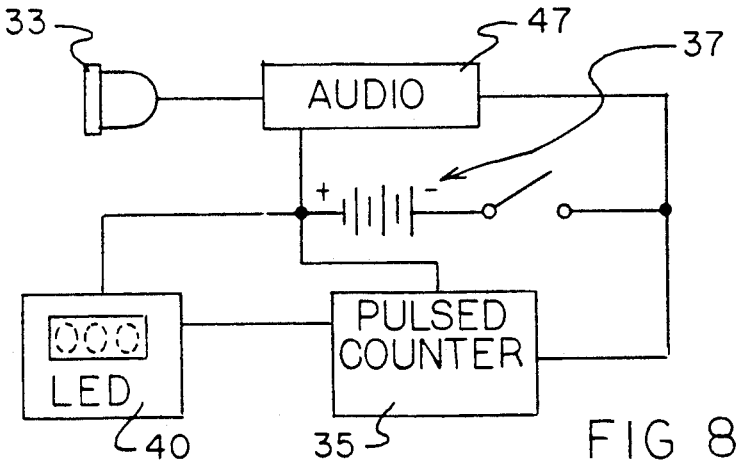
FIG. 8 is an electrical schematic diagram of a circuit used for counting times the bell has been rung.

As shown in FIGS. 7–8, an audible signal counting assembly 30 counts and displays a count of audible signals indicating projectile accuracy. The audible signal counting assembly 30 includes a microphone 33 for sensing the audible signals when a projectile 15 hit the target element 24. The microphone 33 provides a pulsed electrical signal representing a target hit. The electrical signals from the microphone 33 are received and processed by an audio signal processor assembly 47 counted by a pulse counter 35. The counts are displayed on an LED digital display 40. The audible signal counting assembly 30 may be powered by batteries 37. The audible signal counting assembly 30 includes a curved bottom member 49 which can engage the transverse rod 25. A peg 36 is used to secure the audible signal counting assembly 30 to the transverse rod 25 through an aperture 38 near the apex of an end unit 19.

The apparatus 10 of the invention shown in FIG. 1 can be easily assembled and disassembled. One end of traverse rod 25 is inserted through the triangular opening between the upper apex of the end unit 19 and the transverse rod support 21. Then, with one of the transverse rod 25 being supported by the end unit 19, the second end unit 19 is passed onto the other end of the transverse rod 25. The second end of the transverse rod 25 is then supported by the second end unit 19. To disassemble the support assembly 13, the assembly steps are reversed.

Most of the components of the projectile accuracy signalling apparatus of the invention can be made from inexpensive and durable wood, metal, or plastic materials.

The projectile accuracy signalling apparatus of the invention may be used with either a rolling or sliding projectile on the floor or ground surface. For example, in addition to a golf ball, the projectile may be a bowling ball, a croquet ball, a soccer ball, a hockey puck, or a shuffle board disk, among others.

With the invention, the golfer can putt with any number of practice balls (e. g. 10, 15, 30, etc.) without having to clear the balls away from the practice area. With other practice devices, the golfer is penalized for perfection. For example, when the ball makes contact with a target on the other devices, it is likely to settle in front of the target blocking the way for additional practice. The golfer must then walk to the target and remove the ball before continuing practice. Even with a cup device, two or three good putts fill the cup. With the projectile accuracy signalling apparatus of the invention, the ball strikes the target, rings the bell, rolls, past, and does not block the target. This allows for golfer to continue practicing with being penalized for perfection.

Since successful practicing with the projectile accuracy signalling apparatus of the invention results in an audible signa, the golfer can focus more on the point of contact, and not totally rely on visual results. Many short putts are missed because golfers develop a bad habit of peeking at the hole before contact is made with the ball. With the projectile accuracy signalling apparatus of the invention, the golfer can concentrate on the audible signal and repetitively practice short putts while concentrating on making contact with the ball, and then listening for success.

Depending on the size of the practice area, ball retrieval during practice may not be necessary. If the golfer wants to practice 4 foot putts, all the is needed is a 5 foot area. However, if the golfer has a 10 foot area, 4 foot putts can be practiced in one direction, and after putting al the balls through the projectile accuracy signalling apparatus, practice can be continued from the other side. In effect, the golfer does not have to retrieve the balls to continue practicing.

Two famous sayings in golf are "don't leave it short" and "never up, never in." The projectile accuracy signalling apparatus of the invention helps eliminate this problem since the golfer easily becomes aware that contact with the target is the only way to ring the bell. Also, the object of practicing with this device is to putt through the device, thereby reinforcing the need for a firm stroke.

In embodiments of the invention not employing an electronic counter, no batteries and no electricity is needed in using the projectile accuracy signalling apparatus of the invention. Also, the projectile accuracy signalling apparatus of the invention is light weight, easy to assemble, and easily stored either if the apparatus is assembled or disassembled.

It is apparent from the above that the present invention accomplishes all of the objects set forth by providing a new and improved projectile accuracy signalling apparatus that is low in cost, relatively simple in design and operation, and which may advantageously be used to provide an audible signal when accurate projectile placement has been effected. More specifically, with the invention, restraining one's arms during golf putting is avoided. With the invention, the use of a complex planar surface with an number of channels and targets is avoided. With the invention, the use of a one-piece hilly ramp for practicing golf putting is avoided. With the invention, the use of a complex sighting device for practicing golf putting that employs an articulated mirror is avoided. With the invention, a golf putting practice device is provided that does not cause the user to empty a cup often when the putts are generally accurate.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved apparatus for signalling accuracy of a path of a projectile moving on a floor or ground surface, said apparatus, comprising:

audible signal assembly means for providing an audible signal when hit by a projectile moving along a floor or ground surface, said audible signal assembly means being located above the floor or ground surface, and support assembly means for supporting said audible signal assembly means above the floor or ground surface such that said audible signal assembly means can be hit by a projectile moving along the floor or ground surface, wherein said support assembly means includes:

two triangular-shaped end units in which bases of end units are supported by said the floor or ground surface, transverse rod supports connected to said end units near apices of said end units, and a transverse rod extending transversely between said end units and supported by said transverse rod supports, wherein said audible signal assembly means is supported by said transverse rod.

2. The apparatus described in claim 1 wherein said support assembly means are supported by the floor or ground surface.

3. The apparatus described in claim 1 wherein said transverse rod supports include flat top surfaces for stabilizing support of said transverse rod on said supports.

4. The apparatus described in claim 1 wherein said bases of said end units include stabilizing feet for providing improved stability to said apparatus.

5. The apparatus described in claim 4 wherein said stabilizing feet include flat bottom surfaces.

6. The apparatus described in claim 1 wherein a projectile rolls along the floor or ground surface.

7. The apparatus described in claim 1 wherein said audible signal assembly means include:

bell assembly means, including a bell member and clapper assembly means, for sounding an audible signal when said clapper assembly means are actuated, and target assembly means, connected to said clapper assembly means, including target element support means and target element, said target element, supported near and above a ground or floor level, for receiving impact of a projectile that moves along the floor or ground, said target element support means for actuating said clapper assembly means for striking said bell element for sounding an audible signal when said target element is hit by the moving projectile.

8. The apparatus described in claim 7 wherein said clapper assembly means are connected to said bell member.

9. The apparatus described in claim 1, further including:

curved wall means, connected to said support assembly means, for returning a moving projectile, which moves up a portion of said curved wall means, back toward a person who initially moved the projectile to said curved wall means.

10. The apparatus described in claim 1, further including:

ramp means and receptacle means, located on the floor or ground, said ramp means for guiding projectiles up from floor or ground level into said receptacle means, said receptacle means for retaining projectiles.

11. The apparatus described in claim 1, further including:

audible signal counting assembly means for counting and displaying a count of audible signals indicating projectile accuracy, wherein said audible signal counting assembly means include:

a microphone for sensing the audible signals and for providing an electrical signal, and means for receiving and counting electrical signals from said microphone.

12. The apparatus described in claim 11 wherein said audible signal counting assembly means are powered by batteries.

13. The apparatus described in claim 11 wherein said audible signal counting assembly means include a digital display.

14. The apparatus described in claim 11 wherein said audible signal counting assembly means are supported by said support assembly means.

15. The apparatus described in claim 1 wherein a projectile maybe a golf ball.

* * * * *